US006035785A

United States Patent [19]

Sabathier et al.

[11] Patent Number: 6,035,785

[45] Date of Patent: Mar. 14, 2000

[54] EXPLOSIVELY-FORMED CHARGE WITH ATTACHMENT MEANS BETWEEN THE LINER AND THE CASING

[75] Inventors: Patrick Sabathier, Saint Palais; Thierry Soulat, Bourges; Jean-Marie Montigny, Olivet; Jean-Luc Renaud-Bezot, Bourges, all of France

[73] Assignee: Giat Industries, France

[21] Appl. No.: 09/015,945

[22] Filed: Jan. 30, 1998

[30] Foreign Application Priority Data

Feb. 6, 1997 [FR] France ..... 97 01340

[51] Int. Cl.[7] ..... F42B 12/10

[52] U.S. Cl. ..... 102/476; 102/306; 102/501

[58] Field of Search ..... 102/501, 306–310, 102/476

[56] References Cited

U.S. PATENT DOCUMENTS

| | | | |
|---|---|---|---|
| 3,025,794 | 3/1962 | Lebourg et al. | 102/306 |
| 4,080,898 | 3/1978 | Gieske . | |
| 4,702,171 | 10/1987 | Tal et al. . | |
| 4,747,350 | 5/1988 | Szecket . | |
| 4,776,278 | 10/1988 | Scholles et al. | 102/476 |
| 4,922,825 | 5/1990 | Aubry et al. . | |
| 5,153,373 | 10/1992 | Lips et al. | 102/501 |
| 5,744,747 | 4/1998 | Renaud-Bezot et al. | 102/476 |
| 5,792,980 | 8/1998 | Weimann | 102/501 |

FOREIGN PATENT DOCUMENTS

| | | | |
|---|---|---|---|
| 437992 | 7/1991 | European Pat. Off. | 102/476 |
| 2655719 | 6/1991 | France . | |

*Primary Examiner*—Harold J. Tudor
*Attorney, Agent, or Firm*—Parkhurst & Wendell, L.L.P.

[57] ABSTRACT

A shaped charge, notably an explosively formed charge, incorporating an explosive charge arranged in a casing and onto which is placed a liner intended to be set into motion by the detonation of said explosive charge. The liner incorporates at least two plates, a rear plate which is in contact with said explosive charge and which is connected to said casing by attachment means and at least one front plate which is connected to said rear plate by bonding. The attachment means is positioned between a cylindrical peripheral surface of said rear plate and an inner cylindrical surface of said casing.

8 Claims, 3 Drawing Sheets

EXPLOSIVELY-FORMED CHARGE WITH ATTACHMENT MEANS BETWEEN THE LINER AND THE CASING

FIELD OF THE INVENTION

The technical scope of the present invention is that of explosively-formed charges.

Such charges generally incorporate an explosive load arranged in a casing and a liner which is roughly in the shape of a spherical cap.

BACKGROUND OF THE INVENTION

When an explosively formed charge is detonated, a liner is set into motion by the incidental pressure wave. The liner is deformed by turning inside out, that is to say it is transformed into a projectile (or slug) whose front part is formed by the axial zone of the liner and whose rear part is a skirt formed by the periphery of the liner.

Patent FR2627580 describes such a charge.

When designing such a charge, the problem usually arises of how to make the liner integral with the charge casing.

Generally a solution is found whereby the liner is held in position axially by being shrunk fit onto the internal cylindrical surface of the casing.

Axial retention can also be ensured by means of an abutment formed by a rim, integral with the casing, and positioned in front of a peripheral circular zone of the liner.

Such known solutions are described in patent FR2657156.

However, they are not entirely satisfactory, in particular in the event that the liner material is a ductile material or a material for which the formation of the slug is perturbed by the presence of local stresses on the liner.

Thus, shrink-fitting generates stresses on the periphery of the liner which perturbs the formation and reproducibility of the slug skirt.

The presence of an abutment in front of a circular zone of the liner presents the risk of tearing off the skirt from the slug, thus seriously perturbing its stability.

Moreover, explosively-formed charges are subject, during storage phases, to thermal constraints which cause dilations whose magnitude differs for the explosive charge and the metal casing.

Such dilations (which generate constraints at the contact points) further complicate the design of the means to link the liner and the casing.

So as to increase the ballistic performances of the slugs, the thickness of the peripheral part of the liner in contact with the casing also has to be reduced.

When this part becomes too thin, gases generated by the detonation of the load can leak at the contact zone between the casing and liner, a zone which is already greatly stressed by the expansion of the products of the detonation.

These leaks seriously perturb the formation of the slug skirt thereby reducing its ballistic performances.

OBJECT AND BRIEF SUMMARY OF THE INVENTION

The aim of the present invention is to propose an explosively-formed charge which does not present such drawbacks.

The liner of the charge according to the invention is thus attached in a simple and rigid manner which does not perturb the formation of the slug.

It is retained in place whatever the thermal constraints to which it is subjected.

Moreover, thanks to the invention, it is possible to design a liner having a very thin peripheral zone without the risk of gas leaks which would perturb the formation of the slug skirt.

These attachment means according to the invention also enable the formation of peripheral fins on the rear part of the slug to be controlled, thereby improving its aerodynamic stability.

Thus, the subject of the invention is a shaped charge, notably an explosively formed charge, incorporating an explosive charge arranged in a casing and onto which is placed a liner intended to be set into motion by the detonation of the explosive, a charge characterized in that the liner incorporates at least two plates, a rear plate which is in contact with the explosive load and which is connected to the casing by attachment means and at least one front plate which is connected to the rear plate by bonding, the attachment means being positioned between a cylindrical peripheral surface of the rear plate and an inner cylindrical surface of the casing.

Each attachment means will, advantageously, incorporate an incipient fracture and/or will mark out a fracture zone on the rear plate. Such an arrangement will facilitate the separation of the liner and the charge casing during the formation of the slug.

The charge will preferably incorporate at least three attachment means evenly spaced at an angle around the charge axis.

According to a first embodiment, each attachment means is formed by a screw positioned radially with respect to the charge axis, a screw which passes through the charge casing and one end of which penetrates in a housing arranged on the external cylindrical surface of the rear plate.

According to a second embodiment, each attachment means is formed of a ball-bearing placed in a radial bore in the casing which cooperates with an indentation arranged on the external cylindrical surface of the rear plate.

According to a third embodiment, each attachment means is formed by a cylindrical pin, or a piano wire, whose axis is both perpendicular to the charge axis and tangent to the external cylindrical surface of the rear plate, a pin which cooperates with a first indentation arranged on the external cylindrical surface of the rear plate and with a second indentation made on the inner cylindrical surface of the casing.

According to a fourth embodiment, each attachment means is formed by a flexible clip placed in a housing arranged on the periphery of the rear plate, a clip incorporating a deformable tip intended to penetrate in a groove arranged on the inner cylindrical surface of the casing so as to ensure that the first plate is axially connected to the charge casing.

The rear plate will preferably be made of aluminium or aluminium alloy.

BRIEF DESCRIPTION OF THE DRAWINGS

The invention will be better understood after reading the following description of the different embodiments, a description made in reference to the appended drawings, in which.

MORE DETAILED DESCRIPTION

Figure 1A:
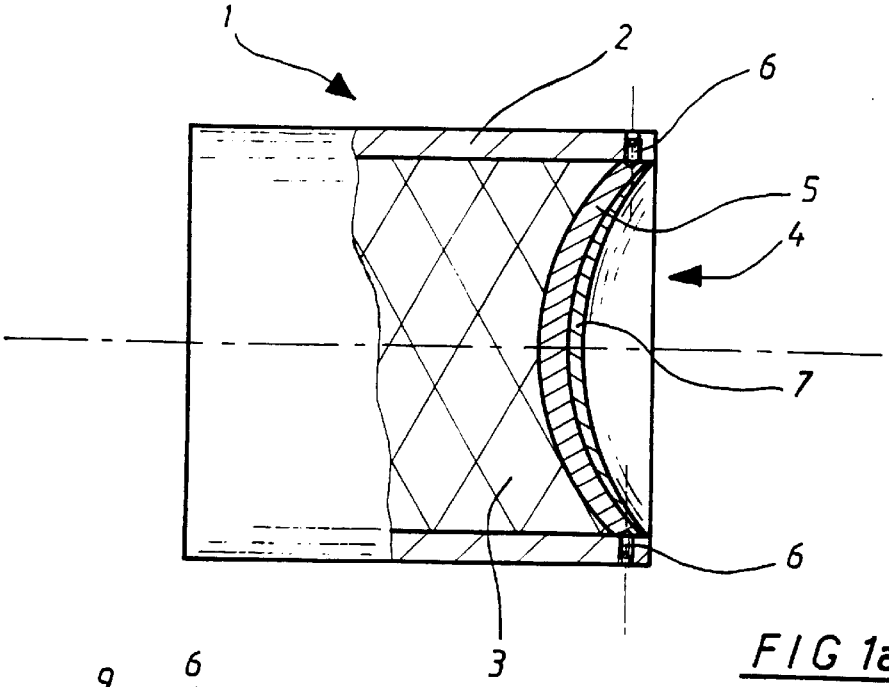
FIG. 1*a* represents a schematic partial longitudinal section of an explosively formed charge according to a first embodiment of the invention.
Figure 1B:
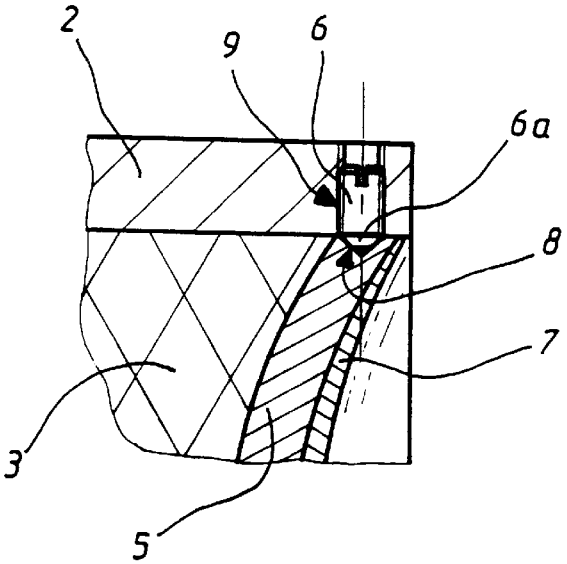
FIG. 1*b* is an enlarged view of this same charge showing the attachment means in detail.

With reference to FIG. 1, an explosively formed charge 1 according to the invention incorporates in a known manner a cylindrical casing 2 inside which is placed an explosive load 3 to which a metal liner 4 is applied.

The explosive load is intended to be ignited by priming means of a known variety and not shown here.

Liner 4 in this example incorporates at least two plates, a rear plate 5 and a front plate 7.

Rear plate 5 is in contact with explosive load 3 and is connected to casing 2 by attachment means.

Front plate 7 is connected to the rear plate by bonding.

The attachment means in this example are constituted by four screws 6 evenly spaced at an angle and which are housed in radial tappings 9 arranged in casing 2.

Each screw has a conical end 6*a* which penetrates in a matching conical housing 8 arranged on a cylindrical peripheral surface of rear plate 5.

When the charge is ignited, rear plate 5 and front plate 7 of the liner are deformed by the shock wave communicated by the explosive.

Conical housings 8 embrittles the rear plate which fractures around its attachment means.

As a result, the shock wave received by front plate 7, which is of the same angular symmetry as attachment means 6, is modulated.

Stabilizing fins are thus formed on the skirting of the slug generated by front plate 7.

Moreover, because they are arranged between the cylindrical peripheral surface of the rear plate and the inner cylindrical surface of the casing, the attachment means 6 of the liners do not perturb the formation of the slug generated by front plate 7, as there is no obstacle placed in front of the liner.

Rear plate 5 also prevents the formation of gas leaks at the periphery of the front plate as it is set into motion. It is thus possible to design a liner whose front plate has a very thin peripheral zone without causing problems of gas leakage or problems to connect the liner.

Rear plate 5 lastly immobilizes explosive load 3 with respect to casing 2.

When the charge is under stress, for example when it is fired from its carrier, front plate 7 is only subjected to its own forces of inertia which are equilibrated by the bonding of the front plate onto the rear plate.

Rear plate 5 will preferably be made of metal, for example, a light alloy such as an aluminium alloy.

This rear plate is not greatly instrumental in the perforation of the target, and the perturbations to which its skirting is subjected, further to the presence of the attachment means, do not alter the effectiveness of the charge.

Front plate 7 is intended to generate the slug which has a perforating capability, and will be made of iron or tantalum.

By way of a variant, it is naturally possible to provide a different number of screws. The number of attachment means selected determines the number of fins made in the resulting slug.

At least three attachment means evenly spaced at an angle will be provided in order to generate three fins on the slug.

Different means can be used to ensure the connection between rear plate 5 and the casing 2 of the charge.

Figure 2:
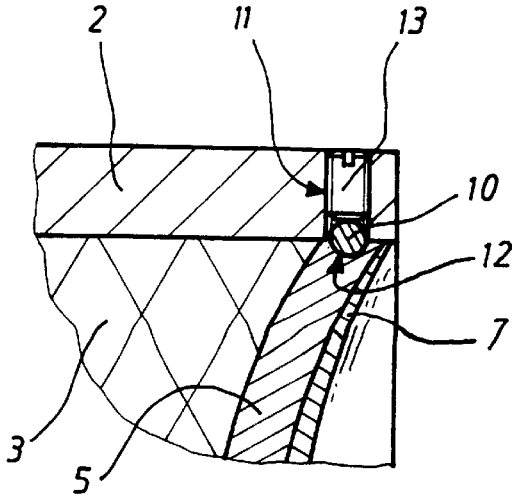
FIG. 2 is a detailed view of an attachment means used in an explosively formed charge according to a second embodiment of the invention.

FIG. 2 thus shows an embodiment in which the attachment means are formed by steel ball-bearings 10 which are placed, during the assembly of the charge, into radial bores 11 arranged in the casing.

Ball-bearings 10 cooperate with spherical indentations 12 made in the external cylindrical surface of rear plate 5, which is thus embrittled by the presence of the indentations.

The ball-bearings thereby constitute obstacles between rear plate 5 of the liner and casing 2 of the charge. Each ball-bearing is held axially in its bore by a threaded plug 13.

Figure 3B:
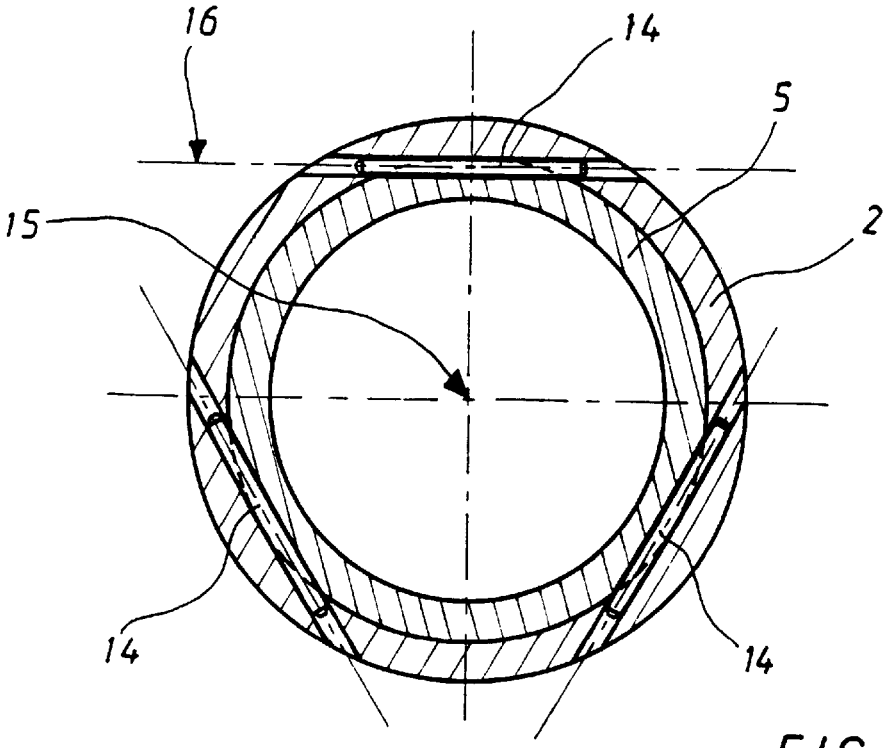
FIG. 3*b* is a section view of this charge along plane AA in FIG. 3*a,*
Figure 3A:
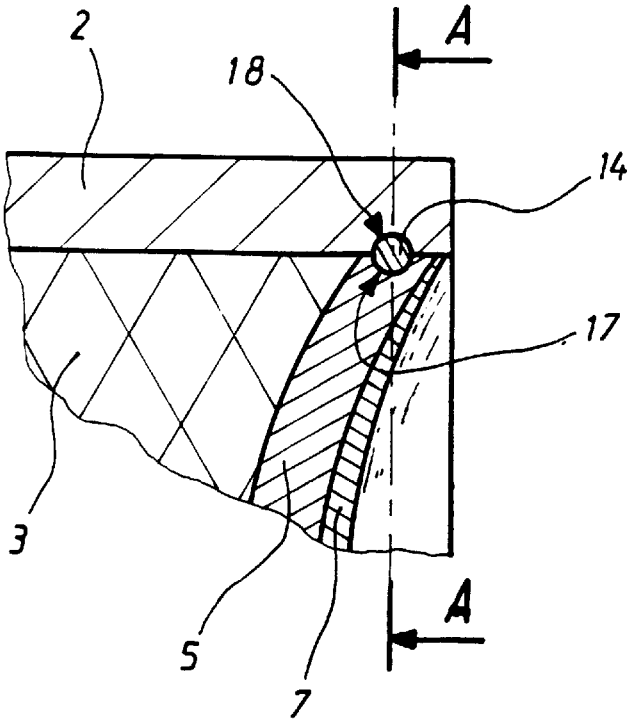
FIG. 3*a* is a detailed view of an attachment means used in an explosively formed charge according to a third embodiment of the invention.

FIGS. 3*a* and 3*b* show a third embodiment in which the attachment means are formed by three cylindrical pins 14 (or three lengths of piano wire).

Axis 16 of each pin is both perpendicular to axis 15 of the charge (projected) and tangent of the external cylindrical surface of rear plate 5.

Each pin 14 cooperates with a first indentation 17 arranged on the external cylindrical surface of rear plate 5 (and which embrittles the latter locally) and with a second indentation 18 made in the internal cylindrical surface of casing 2.

The advantage of this embodiment lies in that, with respect to the embodiment shown in FIG. 2, a pin 14 having a smaller diametre than ball-bearing 10 may be used whilst providing a greater contact surface area, be it with rear plate 5 or casing 2. This allows the shearing stress to be distributed better.

Figure 4A:
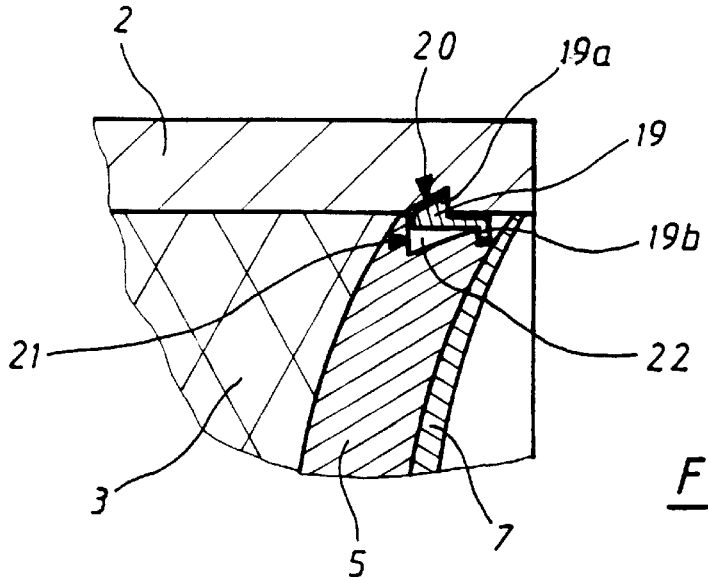
FIG. 4*a* is a detailed view of an attachment means used in an explosively formed charge according to a fourth embodiment of the invention.
Figure 4B:
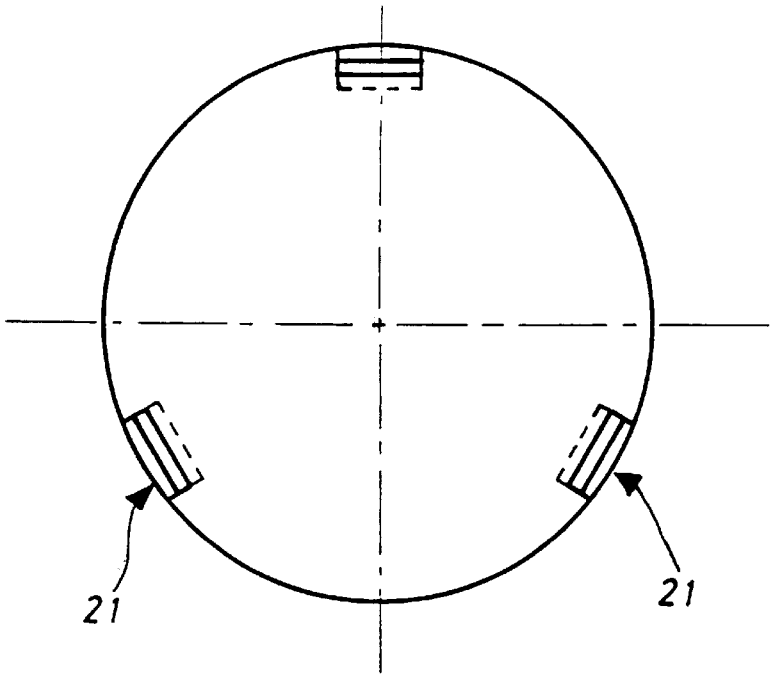
FIG. 4*b* is a view of the rear plate alone used in this fourth embodiment.
Figure 4C:
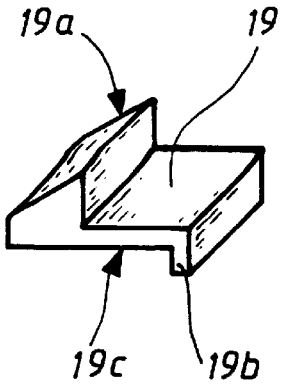
FIG. 4*c* is a view of the attachment means alone, and is the clip intended to be associated with this rear plate.

FIG. 4*a* shows a fourth embodiment in which the attachment means are formed by three flexible clips 19, made for example of spring steel.

Each clip comprises a tip 19*a* and a heel 19*b* which are connected together by a flexible portion 19*c*.

Tip 19*a* is intended to penetrate into a groove 20 arranged on the internal cylindrical surface of casing 2.

Each clip 19 is positioned in a housing 21 arranged in the periphery of rear plate 5 (and which mark out a fracture zone on this plate).

Each housing 21 incorporates a recess 22 intended to receive the tip of clip 19 when this is deformed when the rear plate is set into place in the the bore of casing 2.

When the tip of the clip is lying opposite groove 20, it adopts, by bending, its locking position as shown in the Figures.

By way of a variant, it is naturally possible to design a charge whose liner incorporates more than two plates, in particular to generate several slugs able to perforate the target. Whatever the case, the rear plate will ensure the connection between the liner and the charge casing, the other plates (front and middle) will be fastened to one another by bonding.

We claim:

1. A projectile forming shaped comprising:

a casing having a plurality of indentations or holes spaced around an inner cylindrical surface of said casing;

an explosive charge located in said casing;

a projectile forming liner comprising at least two plates, a rear plate in contact with said explosive charge and fastened to said casing by a plurality of attachment means, and a front plate bonded to said rear plate;

wherein at least a portion of each of said attachment means penetrates each of said indentation or holes in said casing for fastening said liner to said casing; and said plurality of attachment means are positioned between a cylindrical peripheral surface of said rear plate and said inner cylindrical surface of said casing.

2. A shaped charge according to claim 1 wherein each of said attachment means includes an incipient fracture for creating a fracture zone on said rear plate.

3. A shaped charge according to claim 2, wherein said plurality of attachment means comprise at least three attachment devices evenly spaced by approximately equal angles around the axis of said charge.

4. A shaped charge according to claim 3, wherein each of said attachment devices is formed by a screw positioned radially with respect to said axis, said screw passing through said casing of said explosive charge, the end of said screw penetrating a housing arranged on said peripherical cylindrical surface of said rear plate.

5. A shaped charge according to claim 3, wherein each of said attachment devices comprises a ball-bearing placed in a radial bore in said casing which cooperates with an indentation arranged on said peripherical cylindrical surface of said rear plate.

6. A shaped charge according to claim 3, wherein each of said attachment devices comprises a cylindrical pin, or a piano wire, whose axis is both perpendicular to said charge axis and tangent to said cylindrical peripherical surface of said rear plate, said pin or wire cooperating with a first indentation arranged on said cylindrical peripherical surface of said rear plate and with a second indentation made on said inner cylindrical surface of the casing.

7. A shaped charge according to claim 3, wherein each of said attachment devices comprises a flexible clip placed in a housing arranged on the periphery of said rear plate, said clip comprising a deformable tip for penetrating a groove in said inner cylindrical surface of said casing for ensuring that said first plate is axially connected to said casing.

8. A shaped charge according to claim 7, wherein said rear plate comprises aluminum or aluminum alloy.

* * * * *